US006442775B1

(12) United States Patent
Gransow et al.

(10) Patent No.: US 6,442,775 B1
(45) Date of Patent: Sep. 3, 2002

(54) PIVOTAL DUAL-HEAD SHOWER FIXTURE

(75) Inventors: Eckhard Gransow, Fröndenberg; Hans Lobermeier, Menden; Bernd Bischoff, Hemer; Hans-Peter Strelow, Freiburg; Sascha Körfer, Hemer; Holger Ellerbrock, Unna; Andreas Kirchhoff, Wickede; Thomas Raadts, Fröndenberg; Joachim Störk, Kippenheimg; Hans-Jürgen Linde, Coburg; Uwe Neumann, Bamberg; Andreas Rehklau, Coburg, all of (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 09/963,574

(22) Filed: Sep. 26, 2001

(30) Foreign Application Priority Data

Sep. 27, 2000 (DE) ..... 100 48 987

(51) Int. Cl.[7] ..... A47K 3/22
(52) U.S. Cl. ..... 4/601; 4/615; 239/587.2
(58) Field of Search ..... 4/601, 615; 239/587.2

(56) References Cited

U.S. PATENT DOCUMENTS 1,106,914 A * 8/1914 Bartlett et al. ..... 539/587.2 X
1,107,614 A * 8/1914 Jarvis ..... 239/587.2 X
2,011,446 A 8/1935 Judell ..... 4/615 X
2,024,930 A * 12/1935 Judell ..... 4/615 X
2,100,186 A 11/1937 Hagopian ..... 4/601 X
2,240,392 A 4/1941 Dowell ..... 239/587.2 X
3,666,179 A 5/1972 Peschcke-Koedt ... 239/587.2 X
3,971,074 A 7/1976 Yxfeldt ..... 4/601 X
4,975,993 A 12/1990 Black et al. ..... 4/601

* cited by examiner

*Primary Examiner*—Robert M. Fetsuga
(74) *Attorney, Agent, or Firm*—Herbert Dubno; Andrew Wilford

(57) ABSTRACT

A shower fixture has a base adapted to be fixed to a wall, connected to a pressurized-water supply, and having a pressurized water outlet. A pair of generally parallel and spaced tubes have inner ends pivotal about an inner horizontal axis on the base and outer ends. At least one of the tubes is internally connected at the base to the outlet so that pressurized water can flow from the supply through the base to the tube. An element joins together the two tubes for joint pivoting. A shower head mounted between the outer ends is pivotal on the tube about an outer horizontal axis and is connected internally at the outer axis to the one tube so that water from the one tube can flow into the head.

20 Claims, 11 Drawing Sheets

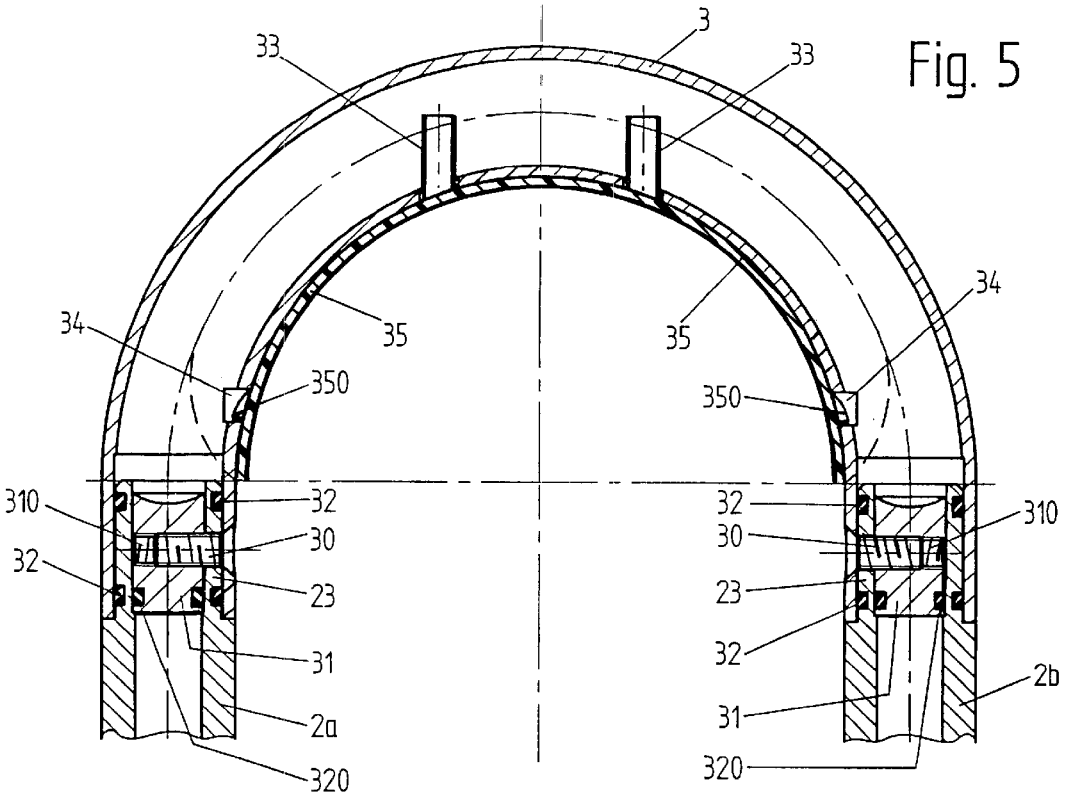
Fig. 5
Fig. 6
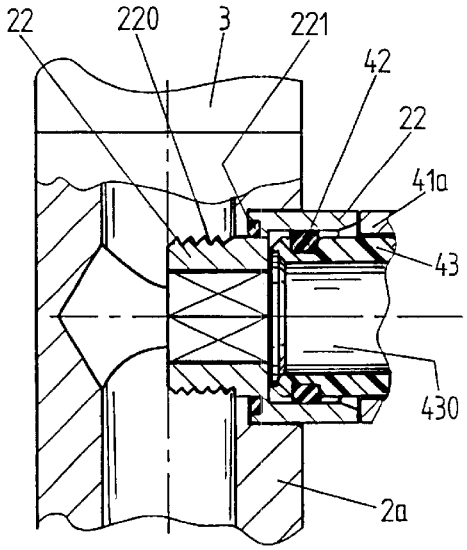
Fig. 7
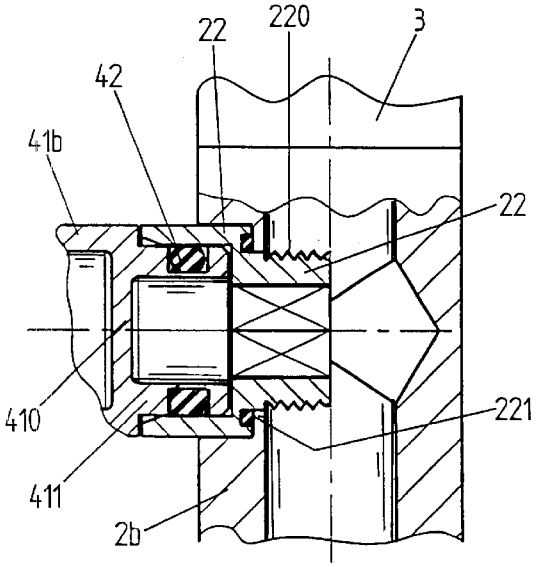

PIVOTAL DUAL-HEAD SHOWER FIXTURE

FIELD OF THE INVENTION

The present invention relates to a shower fixture. More particularly this invention concerns such a fixture having a movable and adjustable shower head.

BACKGROUND OF THE INVENTION

A shower fixture is known, for example from U.S. Pat. No. 2,011,446 of Judell, that has a base adapted to be fixed to a wall, connected to a pressurized-water supply, and having a pressurized water outlet. A normally metal tube has an inner end pivotal about an inner horizontal axis on the base and an outer end. The tube is internally connected at the base to the outlet so that pressurized water can flow from the supply through the base to the tube. A shower head is pivotal on the tube about an otter horizontal axis at the outer end thereof and is connected internally at the outer axis to the one tube so that water from the one tube can flow into the head. The tube is rigid so that the shower head can be swung in an arc. Thus if, as is standard, the base is mounted on an end wall of a tub-shower enclosure, the head cannot be aimed to the side outside the tub.

The system has two main disadvantages. First, the reaction force of the water spraying from the head is often sufficient, at least if the pressure is high, to pivot up the light arm if the head is aimed tangentially of the first axis. The only way to counter this is to make the joints so tight that using the fixture is difficult. Second, the entire arrangement is fairly flimsy so that, if stressed from the side, it is possible to deform or damage it.

Another system shown in U.S. Pat. No. 2,100,186 of Hagiopian has a telescoping horizontal tube arm whose inner end is pivotal about a vertical axis on a wall-mounted base and whose outer end carries a shower head directed perpendicular to the axis of the telescoping tube. Thus the head can be moved in an arc centered on a vertical axis, can be displaced toward and away from the vertical axis by telescoping of the tube, and can be pivoted about the tube axis by twisting of the outer tube part about the tube axis in the inner tube part. This arrangement is somewhat more rigid, but allows the head to be directed outside the shower. In addition the height of the shower head is not variable, making it very difficult for a person to shower without getting his or her hair wet.

OBJECTS OF THE INVENTION

It is therefore an object of the present invention to provide an improved shower-head fixture.

Another object is the provision of such an improved shower-head fixture which overcomes the above-given disadvantages, that is robust, yet that allows the head to be set at any desired height or angle, while making it impossible to spray to the side outside the shower enclosure.

SUMMARY OF THE INVENTION

A shower fixture has according to the invention a base adapted to be fixed to a wall, connected to a pressurized-water supply, and having a pressurized water outlet. A pair of generally parallel and spaced tubes have inner ends pivotal about an inner horizontal axis on the base and outer ends. At least one of the tubes is internally connected at the base to the outlet so that pressurized water can flow from the supply through the base to the tube. An element joins together the two tubes for joint pivoting. A shower head mounted between the outer ends is pivotal on the tube about an outer horizontal axis and is connected internally at the outer axis to the one tube so that water from the one tube can flow into the head.

The use of two connected tubes with the shower head between them is extremely robust and can withstand substantially more transverse stress than the prior-art systems. In addition it is strong enough to resist movement when the shower is turned on full, so that it will hold position. The shower head, however, can only move in an arc centered on the inner horizontal axis and can only pivot about the outer horizontal axis, so it cannot be set to spray outside the shower enclosure.

The element according to the invention is rigid and U-shaped and extends between the outer ends of the tubes. The head lies between the element and the inner axis. In addition the fixture has a second such shower head spaced along the tubes from the first-mentioned head and pivotal on the tubes about a second outer axis spaced from the first-mentioned outer axis and parallel thereto. The second shower head is provided with means for controlling and completely shutting off water flow through the second head. The first shower head is provided with means for controlling but not completely shutting off water flow through the first head. Thus dribbling from the first or outer shower head will signal to the user to turn off the water at the source when the system is connected via a hose to a tub faucet, as is common. This feature is not needed if the system is connected up permanently to the water supply. The outer portions of the tubes carrying the first head can telescope with inner portions of the tubes carrying the second head. In this case the element is rigid and U-shaped and extends between the outer ends of the tubes.

Each of the tubes in accordance with the invention is formed at its inner end with an eye and the base includes respective pivot pins centered on the inner axis and engaged in the eyes. At least one of the eyes is formed with a radially inwardly open groove communicating in the respective tube with an interior thereof. The base is formed with a pressurizable flow passage open at the pin of the one eye level with the groove. The pin of the one eye is adapted to be connected directly to the pressurized water supply. More particularly the pin of the one eye forms a passage extending from the respective socket to the groove. The base further is formed with a rearwardly open port opening into the socket of the pin of the one eye. The fixture further has according to the invention either a plug fixable in the port or a feed tube fittable in the port. The plug is used when the fixture is surface mounted and connected to an existing faucet, the feed tube when it is plumbed in permanently.

For ease of assembly at least one of the tubes is formed of telescoping inner and outer parts at the respective inner end. A seal ring is provided between the parts and a snap ring engaged in confronting grooves in the parts.

The base according to the invention is provided on the inner axis with a screw bearing axially on one of the eyes and pressing same against the base so that the screw can be tightened to increase friction between the eye and the base. In this system the pin of the one eye is provided with a pair of washers flanking the one eye and rotationally fixed to the base.

Each tube according to the invention is provided at the outer axis with a mounting socket. The sockets are axially directed toward each other and the head has a body with end stems fitted to the sockets and rotatable relative thereto. The head is rotatable through 360° about the outer axis. One of the sockets is tubular and forms a passage between the head and the interior of the respective tube. The other socket blocks flow from the respective tube. This reduces the possible leakage sites in the fixture.

The element in accordance with the invention as described above is rigid and U-shaped and extends between the outer ends of the tubes. The tubes are provided at their outer ends with plugs blocking flow out of the outer ends and with screws securing the outer ends, element, and plug together. A separate cover is secured on a concave inner side of the element.

Outer portions of the tubes lie in a plane forming an angle of between 10° and 45° to a plane formed by inner portions of the tube. In addition the base is of generally triangular section, is formed with throughgoing holes adapted to receive screws securing the base to a wall, and is provided with a removable decorative cover concealing the holes.

BRIEF DESCRIPTION OF THE DRAWING

The above and other objects, features, and advantages will become more readily apparent from the following description, reference being made to the accompanying drawing in which:

FIGS. 5, 6, and 7 are large-scale sectional views through details of FIG. 4;

SPECIFIC DESCRIPTION

Figure 1:
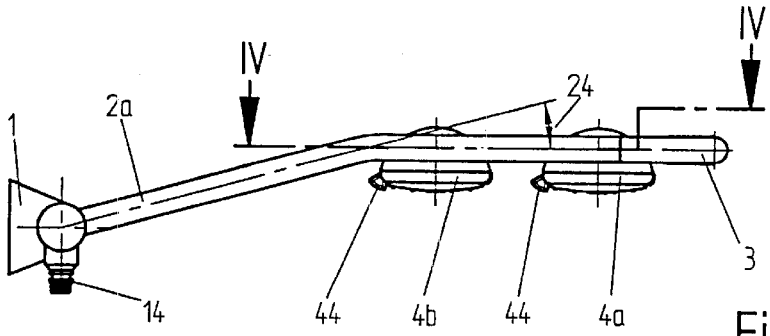
FIG. 1 is a small-scale side view of the shower fixture according to the invention in a use position.
Figure 2:
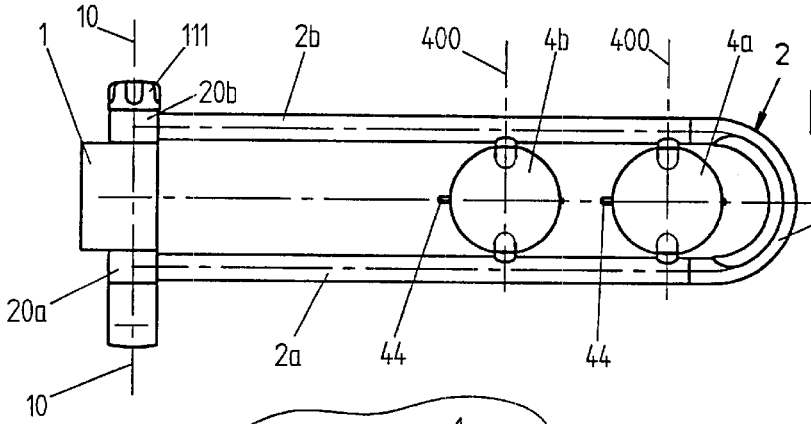
FIG. 2 is a top view of the structure of FIG. 1.
Figure 3:
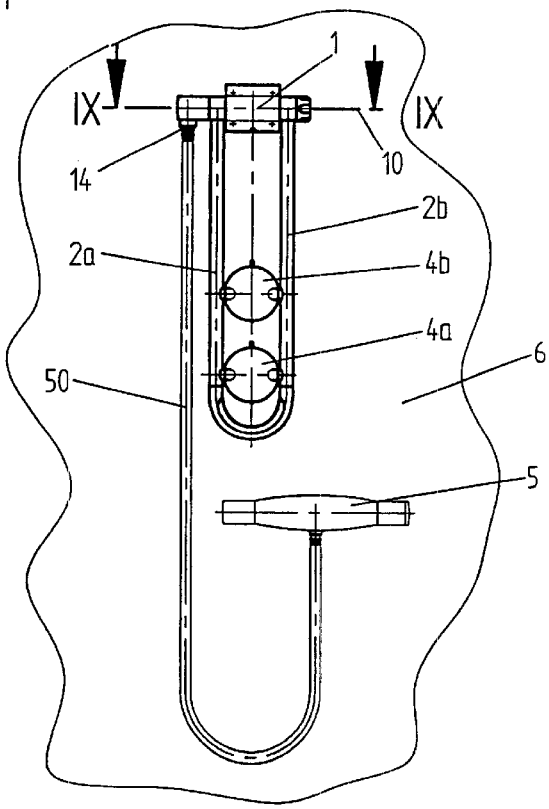
FIG. 3 is a small-scale front view illustrating the installed fixture in a stowed position.

As seen in FIGS. 1 through 8 a shower fixture according to the invention has a stationary base body 1 fixed to a wall 6 (FIG. 3). A U-shaped tube 2 is pivotal about a horizontal inner axis 10 on the base 1 and carries a pair of substantially identical shower heads 4*a* and 4*b* pivotal about respective horizontal outer axes 400 parallel to the axis 10 on an outer end region of the tube 2. The outer portion of the U-tube 2 is bent to lie in a plane forming an angle 24 of about 15° (FIG. 1) with the inner portion close to the base body 1. This allows the heads 4*a* to be aimed plumb while still oriented somewhat above the base 1 as shown in FIG. 1.

Figure 10:
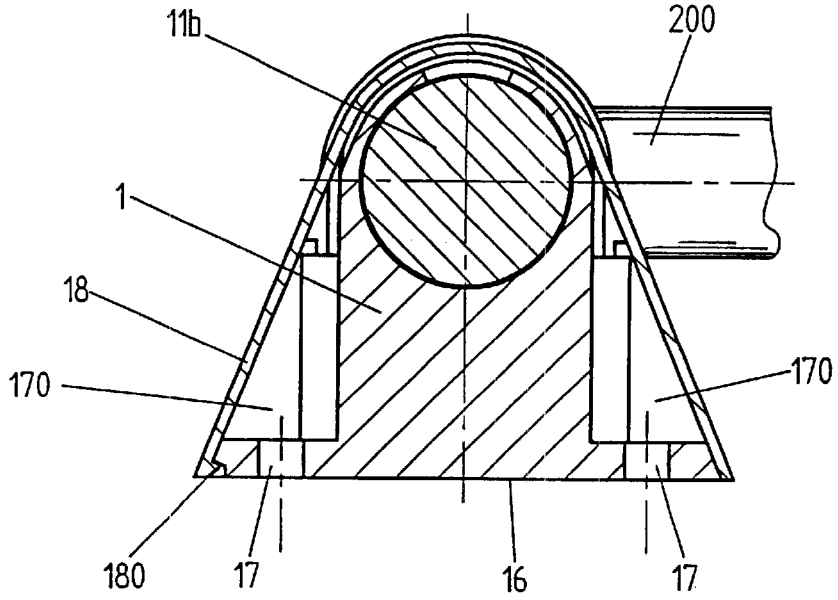
FIGS. 10 and 11 are sections taken along respective lines IX—IX and X—X of FIG. 9.
Figure 11:
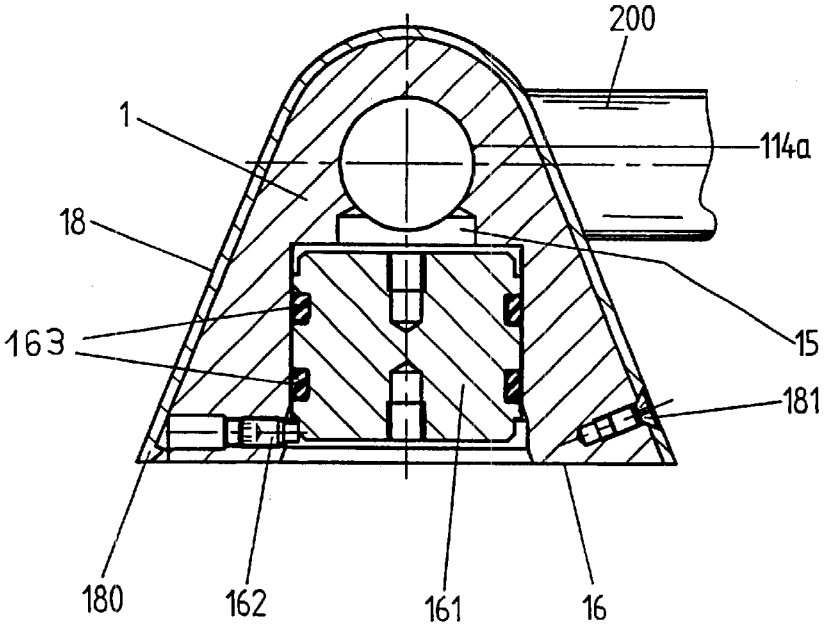
Figure 12:
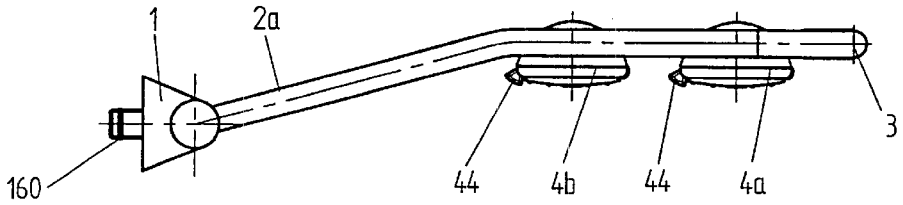
FIGS. 12 and 13 are views like respective FIGS. 1 and 2 of a variant on the shower fixture of this invention.
Figure 13:
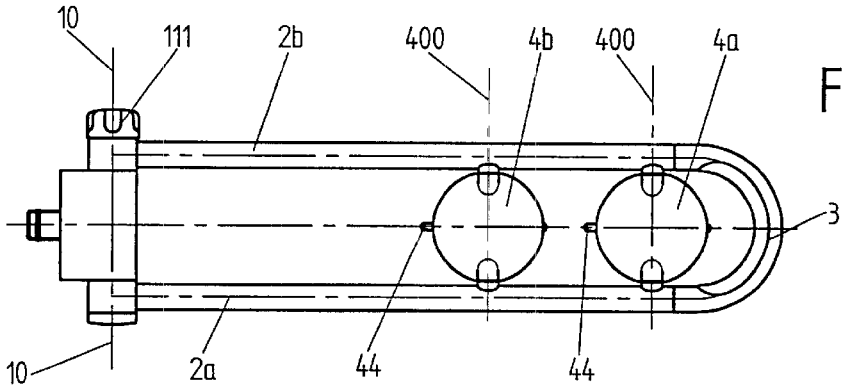
Figure 14:
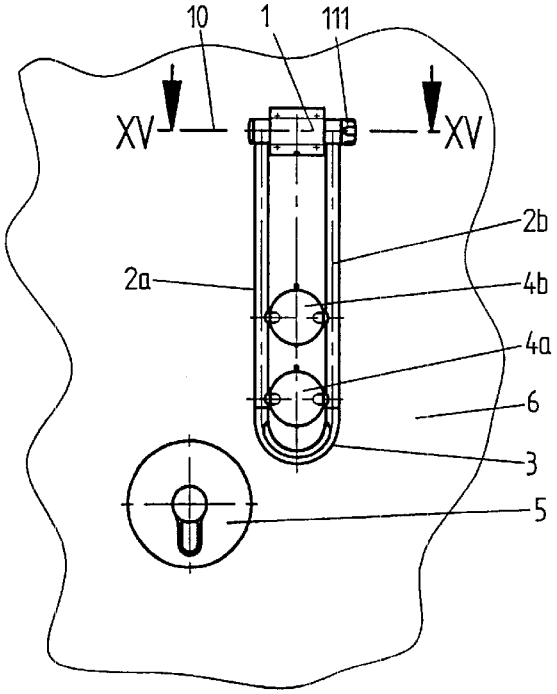
FIG. 14 is a view like FIG. 3 of the fixture of FIGS. 12 and 13.
Figure 15:
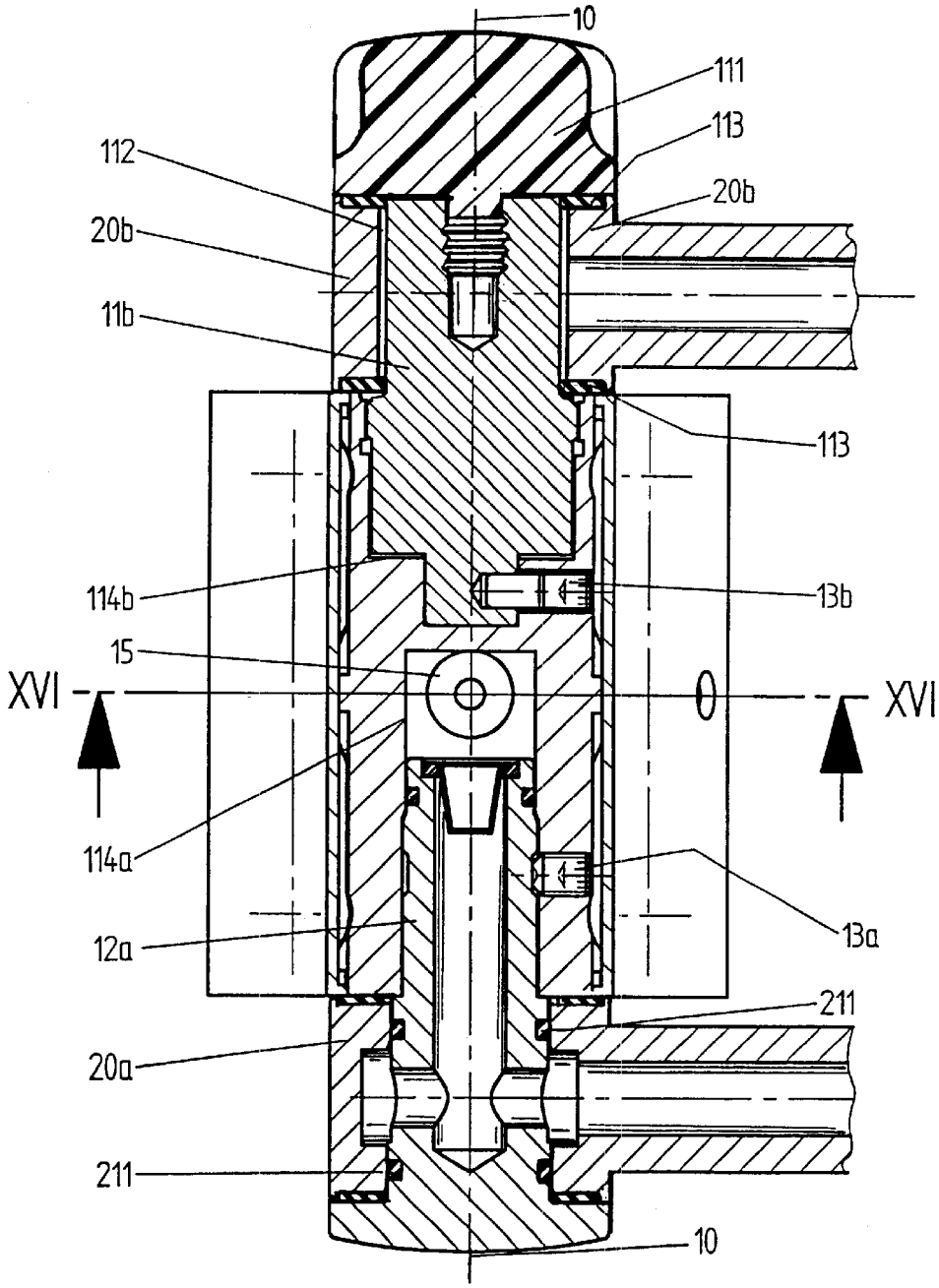
FIG. 15 is a large-scale section taken along lien XV—XV of FIG. 14.
Figure 16:
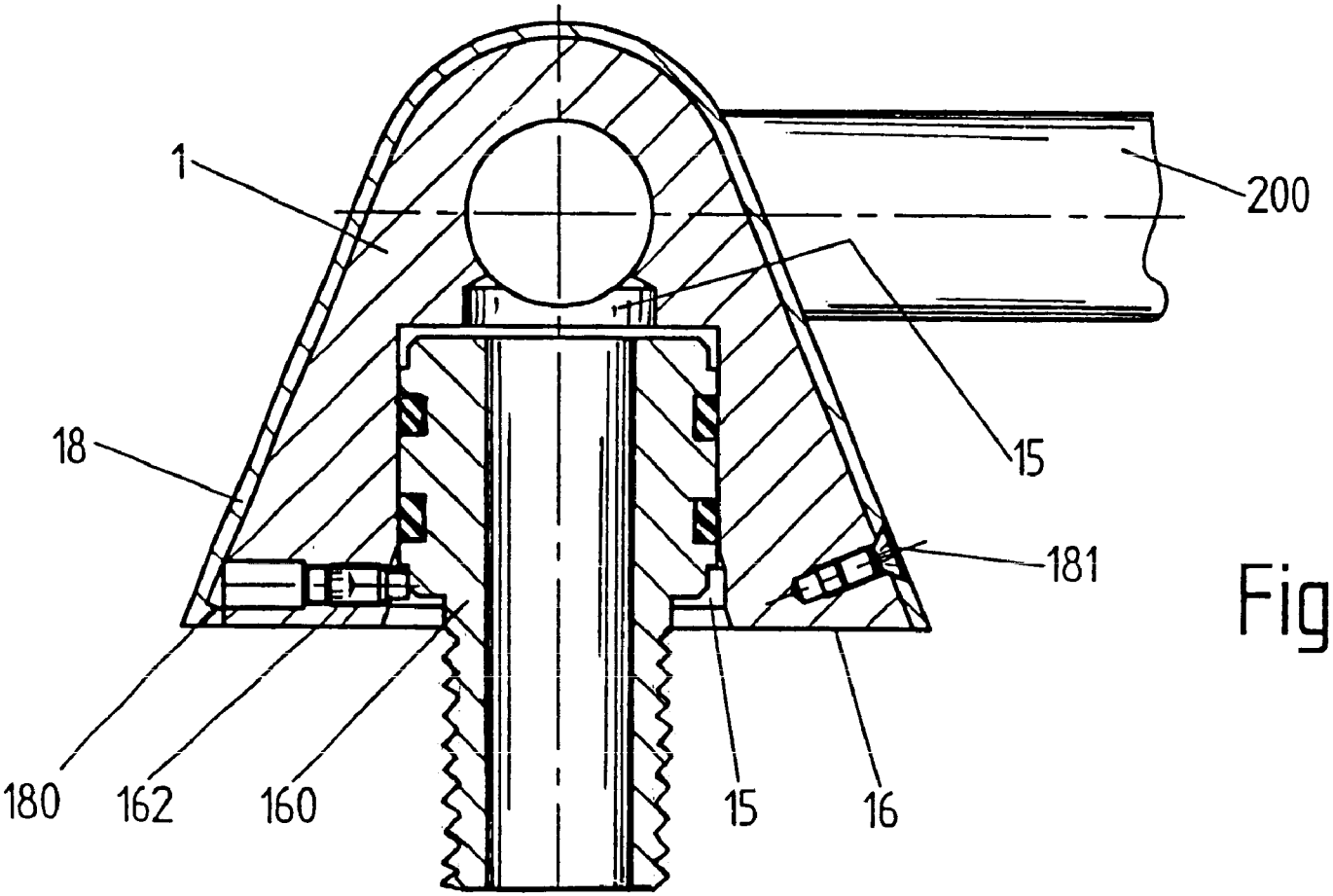
FIG. 16 is a section taken along line XVI—XVI of FIG. 15.

The base body 1 as best shown in FIGS. 10 and 11 has a rear face 16 bearing on the wall 6 and is formed with holes 17 by means of which it can be screwed solidly thereto. Cutouts 170 at the holes 17 accommodate the heads of unillustrated screws. A cover 18 has a tooth ridge 180 that engages under the upper edge of the body 1 and at its lower side this cover 18 is secured in place by a screw 181.

Figure 9:
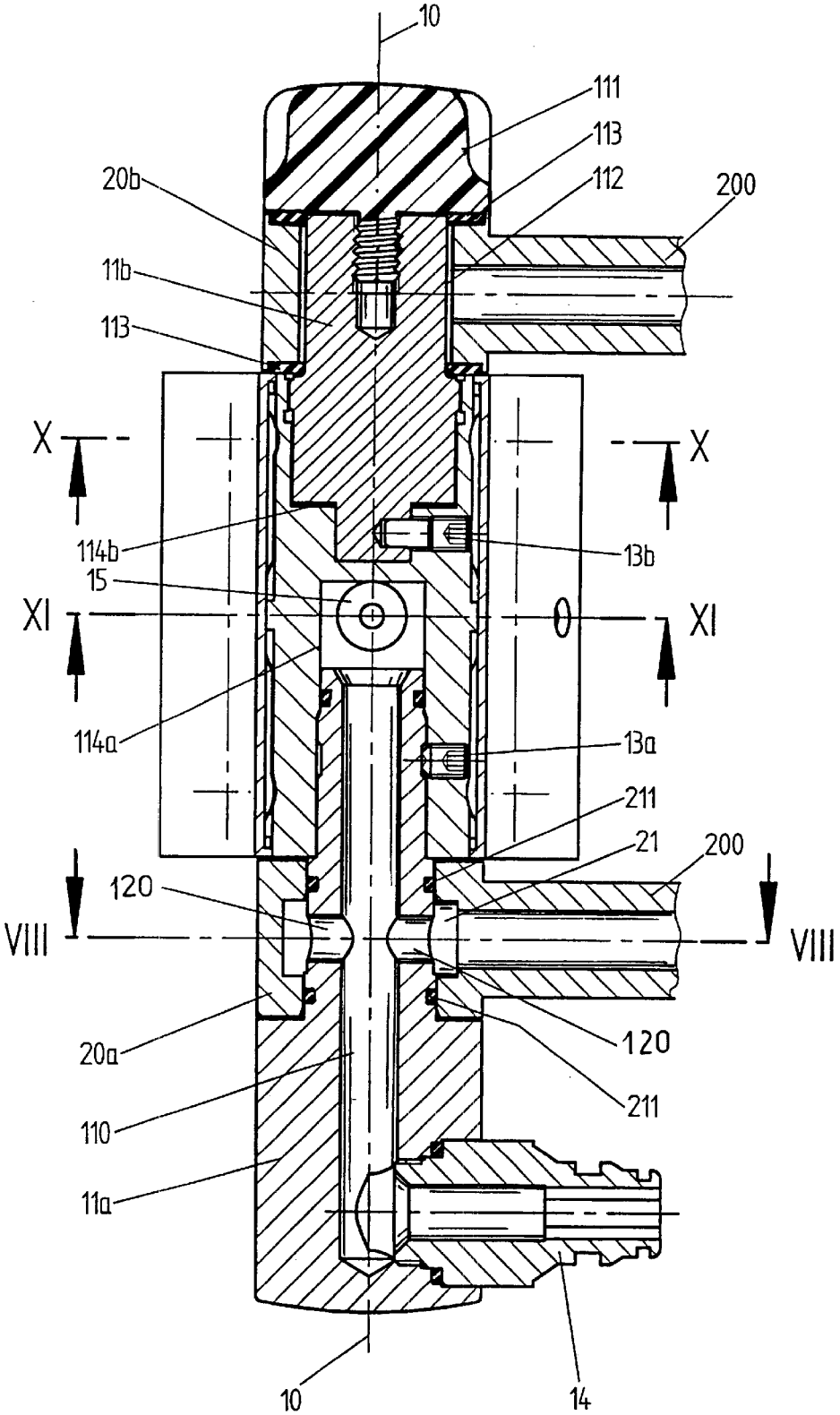
FIG. 9 is a section of the invention.

FIG. 9 shows how the base body is formed with a pair of axially oppositely open cylindrical seats 114*a* and 114*b* centered on the axis 10 and receiving respective mounting pins 11*a* and 11*b* on which are carried eyes 20*a* and 20*b* formed at the inner ends of tubes 200 fitting in tubes 2*a* and 2*b* forming the legs of the U-tube 2. A set screw 13*a* hidden by the cover 18 locks pin 11*a* to the body 1 so that it cannot move at all relative thereto. The pin 11*a* is formed with a central passage 110 opening at its inner end into the seat 114*a*, opening radially centrally via branch passages 120 into a radially inwardly open groove 21 formed in the eye 20*a*, and connected at its outer end to a fitting 14. A hose 50 is connected as shown in FIG. 3 between the fitting 14 and a wall-mounted mixing faucet 5 for pressurization of the passage 110 with water.

The body 1 is also formed as shown in FIGS. 9 and 11 with a rearwardly open hole 15 here blocked by a plug 161 provided with a pair of O-ring seals 163 and secured in place by a set screw 162 hidden by the cover 18. Thus water supplied by the hose 50 will be able to pressurize the passage 110 and the interior of the U-tube 2.

The other pin 11*b* is locked in place by another set screw 13*b* and has external teeth or splines 220 that fit complementarily with the toothed inner peripheries of plastic washers 113 axially flanking the eye 20*b* and, therefore, nonrotatable. A screw 111 threaded into the end of the pin 11*b* bears axially on the outer washer 113 and presses the inner washer 113 via the eye 20*b* against the end of the body 1. This screw 111 can be rotated by hand about the axis 10 to vary the compression of the washers 113 and, therefore, the amount of friction opposing pivoting of the U-tube 2 about the axis 10.

FIG. 5 shows how the outer ends of the tubes 2*a* and 2*b* are interconnected by an element such as a U-shaped bight tube 3. Plugs 31 block the outer ends of the tubes 2*a* and 2*b*, with O-rings 320 preventing any leakage and screws 30 engaged in threaded holes 310 in these plugs 31 to lock them solidly in place. Outer O-rings 32 engage the inner surface of the tube 3 which is also secured in place by the screws 30. A decorative cover 35 engages over the concave inner face of the bight tube 3 and has end teeth 350 snapped into recesses 34 of the tube 3 and central pins 33 similarly fitted to the tube 3 to hold it solidly in place.

Figure 4:
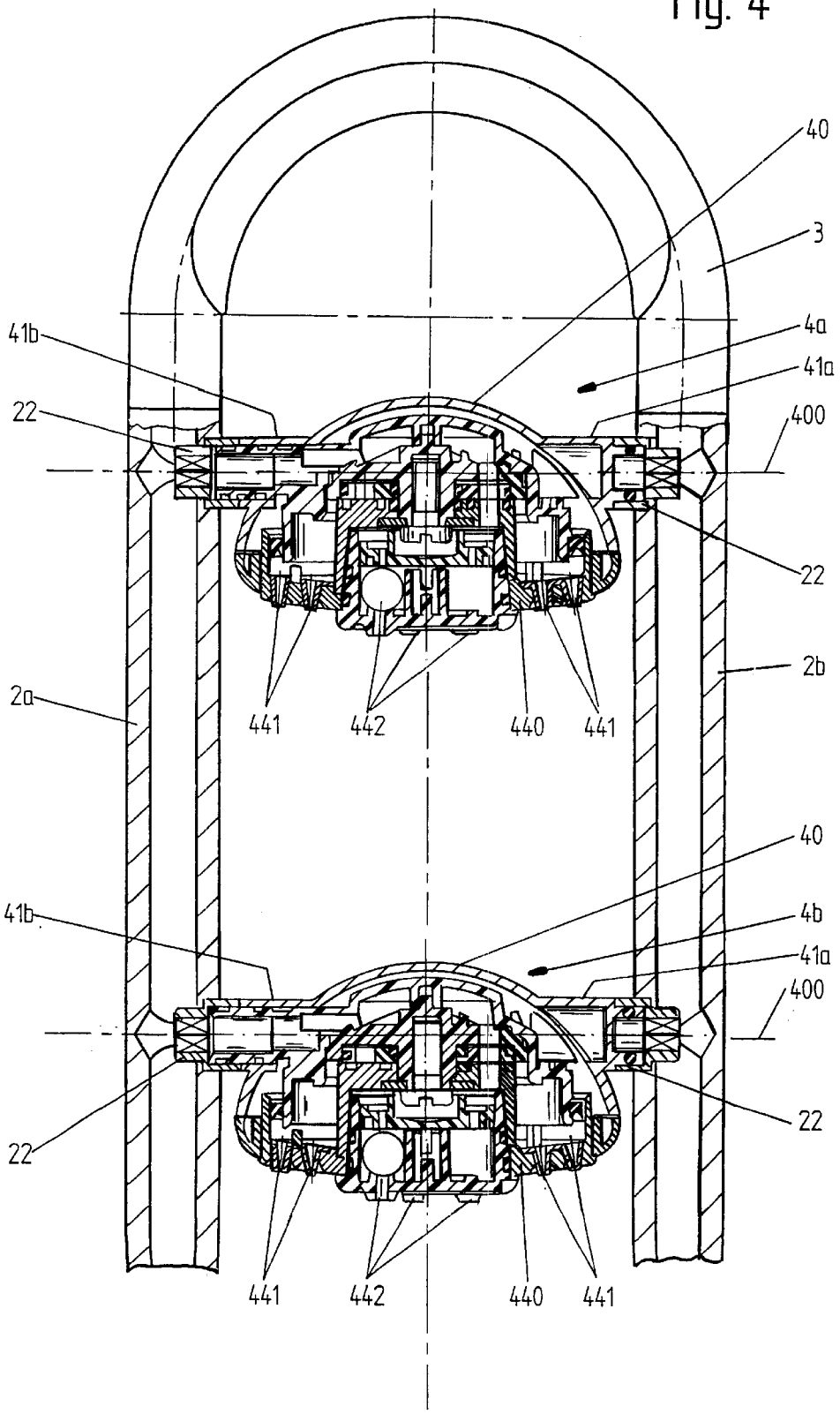
FIG. 4 is a large-scale section taken along line IV—IV of FIG. 1.

As shown in FIGS. 4, 6, and 7, the actual shower heads 4*a* and 4*b* have cup-shaped bodies 40 formed with mounting stems 41*a* and 41*b* centered on the respective axes 400. Each head 4*a* or 4*b* has an outer soft-spray part 440 with nozzles 44*a* and separate inner pulse-spray nozzles 442. An adjustment element 44 (FIG. 2) can be pivoted to select either or both sets of nozzles, and even to shut off flow altogether from the respective head 4*a* or 4*b*. Normally the outer head 4*a* is constructed such that flow through it cannot be shut off altogether, so that the resultant dribbling reminds the user to turn the water off at the faucet 5 at the end of the shower, thereby not leaving the hose 50 under constant pressure.

The legs 2*a* and 2*b* are provided at the outer axes 400 in line with the shower-head stems 41*a* and 41*b* with tubular mounting sockets 22 secured in place by screw threads 220 and sealed by O-rings 221. The shower-head body 40 has coaxially inside the tubular stem 41*a* a tubular inlet fitting 43 that fits in the respective socket 22, sealed relative thereto by an O-ring 42. Thus water can flow from the leg 2*a* through the respective sockets 22 into passages 430 of the inlets 43 to pressurize the heads 4*a* and 4*b*. On the opposite stem 41*b* each body 40 has a central projection 411 fitted into the respective socket 22 and sealed relative thereto by another O-ring 42. A web 410 blocks flow through the stem 41*b* so that flow is only through the opposite socket 22 into the head 4*a* or 4*b*.

Figure 8:
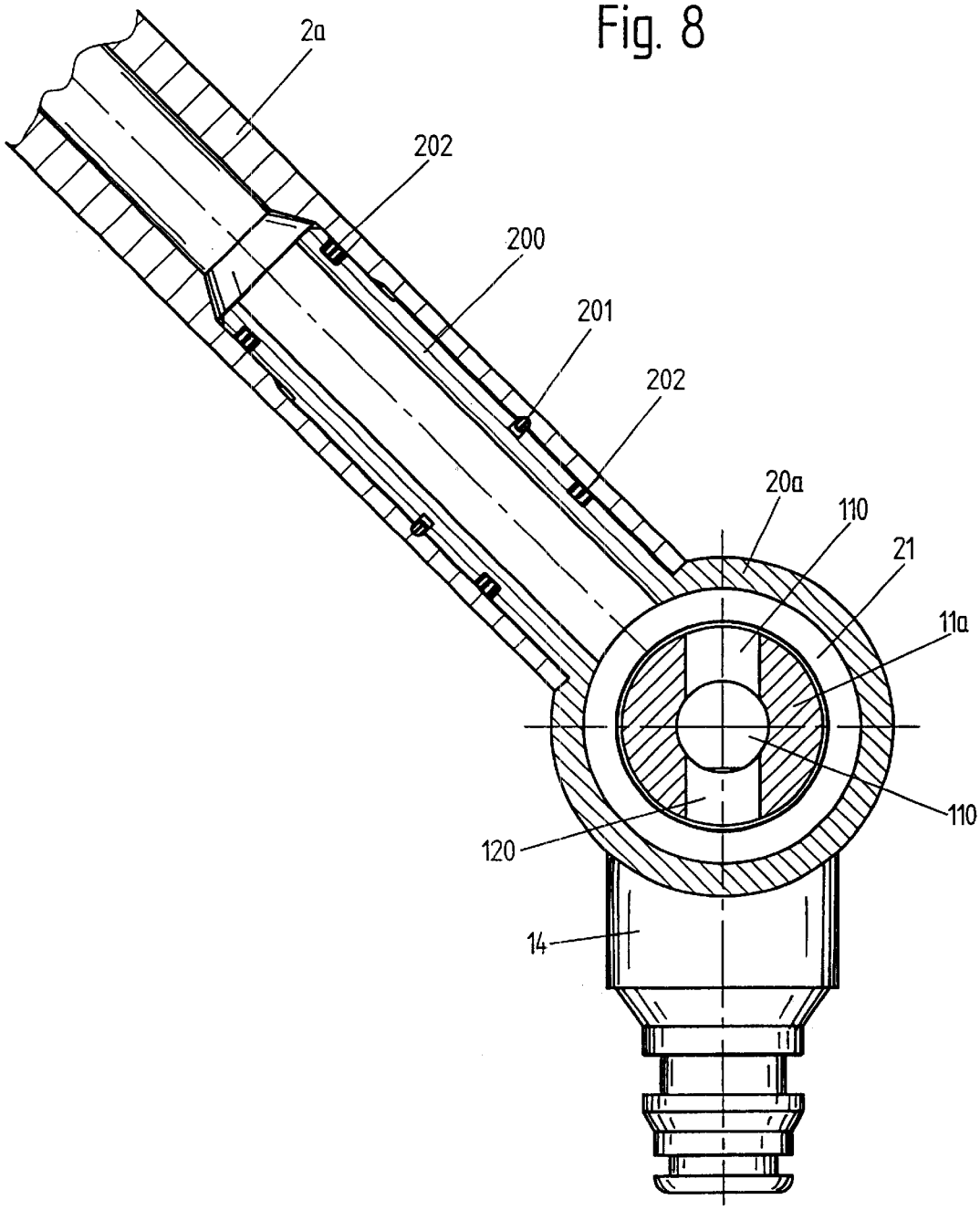
FIG. 8 is a section taken along line VIII—VIII of FIG. 9.

FIG. 8 shows how the inner tube 200 is sealed by O-rings 202 relative to the respective outer tube 2*a*. A snap ring 201 initially fitted to a radially outwardly open groove of the inner tube 200 snaps out into a radially inwardly open groove of the tube 2*a* to axially lock the two parts together. Only a substantial force can separate them so that during normal use the U-tube 2 is of fixed length. The same structure is provided on the other tube section 2*b* which in fact is identical to the part 2*a*.

The system of FIGS. 12 through 16 is adapted to be used without the hose 50 and fitting 14. Here the plug 161 is replaced by a tubular feed nipple 160 having a threaded outer end adapted to be screwed into a female pipe fitting flush with the wall 6. The fitting 14 is replaced by a tubular pin 12*a* having a closed outer end, but otherwise formed identically to the pin 11*a*.

Figure 17:
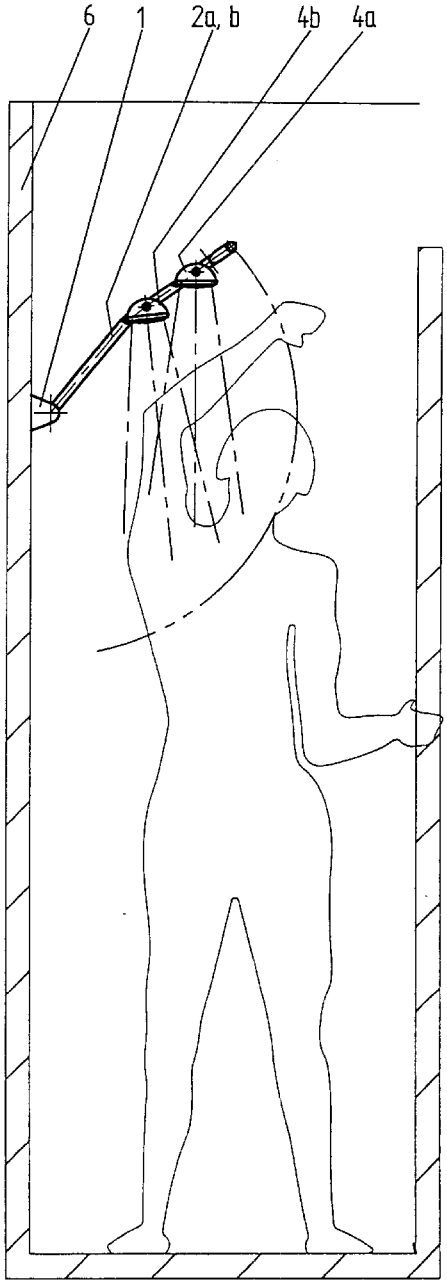
FIGS. 17 and 18 are small scale views illustrating use of the shower fixture in accordance with the invention.
Figure 18:
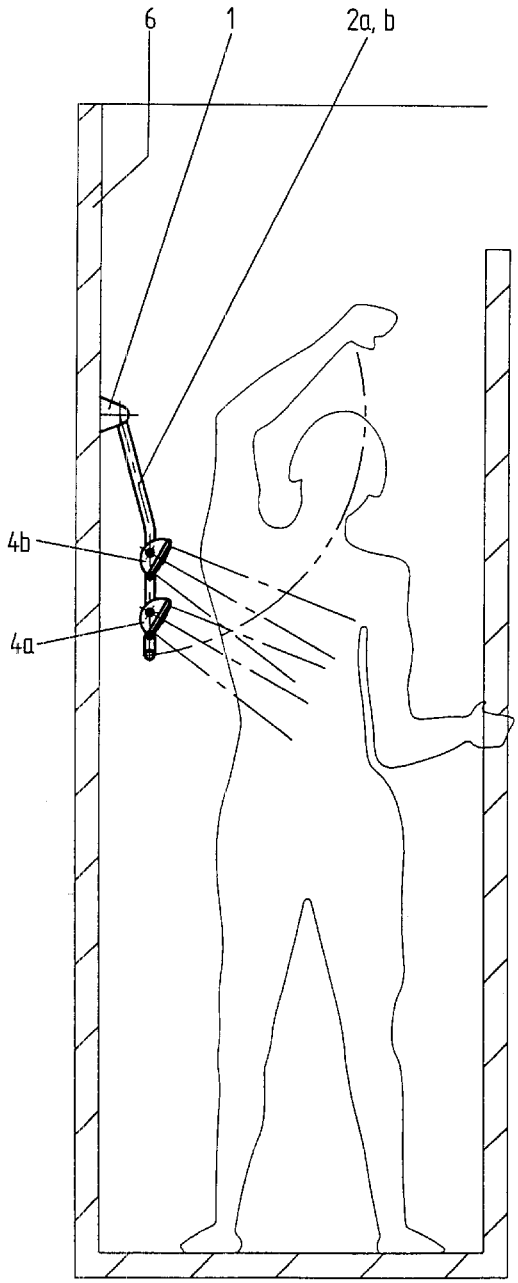
Figure 19:
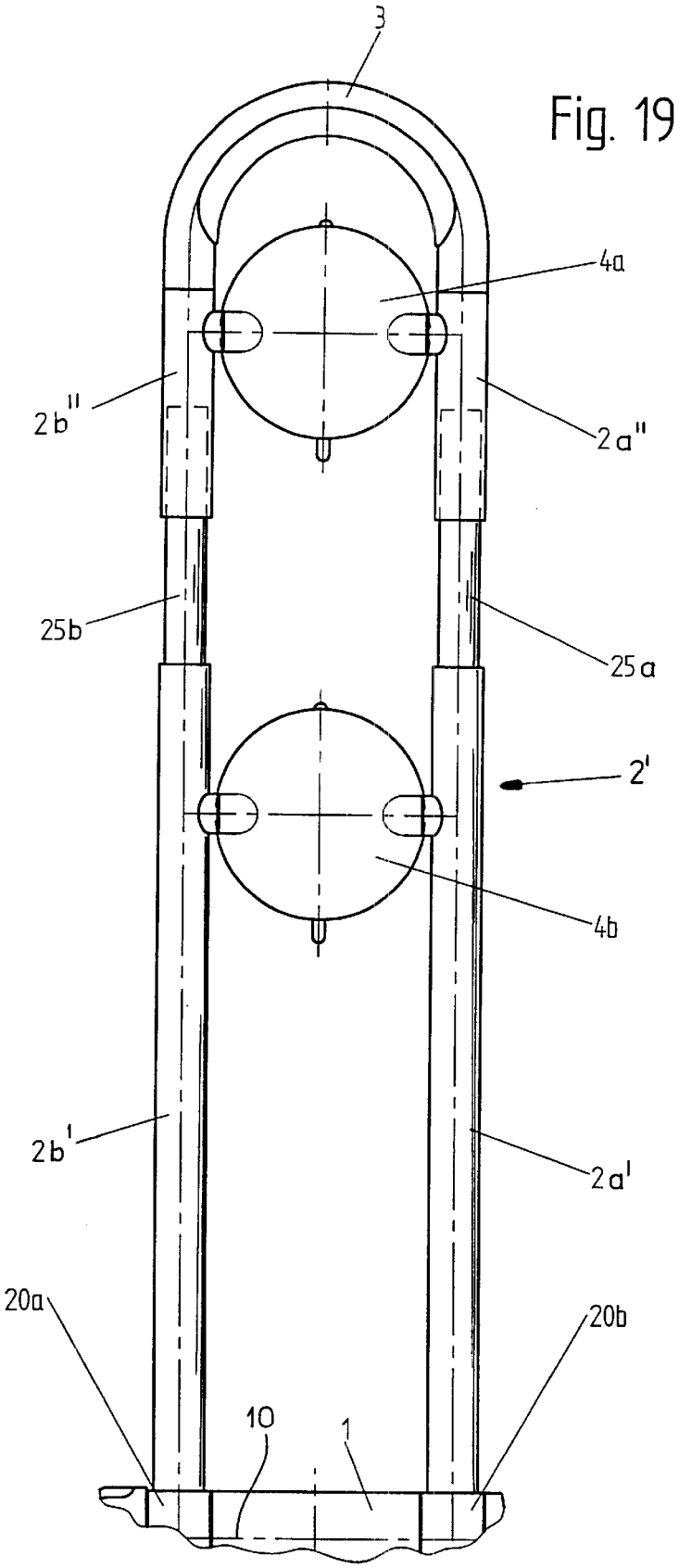
FIG. 19 is a top view of another variant on the fixture according to the invention.

In FIG. 17 the shower system is shown in the fully raised position where it functions as an over-the-head shower. The U-tube 2 is angled upward from the base 1 and the two heads 4*a* are pivoted to direct spray downward. In FIG. 19 the shower system is lowered for washing the body. The U-tube 2 extends almost straight downward and the two heads 4*a* and 4*b* are set at an angle slightly below horizontal so that the user can bathe without getting his or her hair and face wet.

FIG. 19 shows a system with a U-tube 2' whose legs are formed by inner sections 2*a*' and 2*b*' carrying the eyes 20*a* and 20*b*, outer sections 2*b*' and 2*b*" of identical cross section and joined by the bight tube 3, and intermediate tubes 25*a* and 25*b* fixed in the inner sections 2*a*' and 2*b*' and telescopingly limitedly slidable in the outer sections 2*a*" and 2*b*". The inner shower head 4*b* is connected to the two inner sections 2*a*' and 2*b*' so that it stays a fixed distance from the axis 10. The outer shower head 4*a* is connected between the two outer sections 2*a*" and 2*b*" so that, as the outer subassembly formed by the parts 2*a*", 2*b*", and 3 is telescoped trombone-style on the inner sections 2*a*' and 2*b*', the distance from the outer head 4*a* to the axis 10 is varied.

We claim:

1. A shower fixture comprising:

a base adapted to be fixed to a wall, connected to a pressurized-water supply, and having a pressurized water outlet;

a pair of generally parallel and spaced tubes having inner ends pivotal about an inner horizontal axis on the base and outer ends, at least one of the tubes being internally connected at the base to the outlet, whereby pressurized water can flow from the supply through the base to the tube;

an element joining together the two tubes for joint pivoting; and a shower head mounted between the outer ends, pivotal on the tube about an outer horizontal axis, and connected internally at the outer axis to the one tube, whereby water from the one tube can flow into the head.

2. The shower fixture defined in claim 1 wherein the element is rigid and U-shaped and extends between the outer ends of the tubes.

3. The shower fixture defined in claim 2 wherein the head lies between the element and the inner axis.

4. The shower fixture defined in claim 1, further comprising a second such shower head spaced along the tubes from the first-mentioned head and pivotal on the tubes about a second outer axis spaced from the first-mentioned outer axis and parallel thereto.

5. The shower fixture defined in claim 4 wherein the second shower head is provided with means for controlling and completely shutting off water flow through the second head, the first shower head being provided with means for controlling but not completely shutting off water flow through the first head.

6. The shower fixture defined in claim 4 wherein outer portions of the tubes carrying the first head telescope with inner portions of the tubes carrying the second head.

7. The shower fixture defined in claim 6 wherein the element is rigid and U-shaped and extends between the outer ends of the tubes.

8. The shower fixture defined in claim 1 wherein each of the tubes is formed at its inner end with an eye and the base includes respective pivot pins centered on the inner axis and engaged in the eyes.

9. The shower fixture defined in claim 8 wherein at least one of the eyes is formed with a radially inwardly open groove communicating in the respective tube with an interior thereof, the base being formed with a pressurizable flow passage open at the pin of the one eye level with the groove.

10. The shower fixture defined in claim 9 wherein the pin of the one eye is adapted to be connected directly to the pressurized water supply.

11. The shower fixture defined in claim 9 wherein the pin of the one eye forms a passage extending from the respective socket to the groove, the base further being formed with a rearwardly open port opening into the socket of the pin of the one eye, the fixture further comprising:

a plug fixable in the port and a feed tube fittable in the port.

12. The shower fixture defined in claim 11 wherein at least one of the tubes is formed of telescoping inner and outer parts at the respective inner end, the fixture further comprising a seal ring between the parts; and a snap ring engaged in confronting grooves in the parts.

13. The shower fixture defined in claim 11 wherein the base is provided on the inner axis with a screw bearing axially on one of the eyes and pressing same against the base, whereby the screw can be tightened to increase friction between the eye and the base.

14. The shower fixture defined in claim 13 wherein the pin of the one eye is provided with a pair of washers flanking the one eye and rotationally fixed to the base.

15. The shower fixture defined in claim 1 wherein each tube is provided at the outer axis with a mounting socket, the sockets being axially directed toward each other and the head having a body with end stems fitted to the sockets and rotatable relative thereto, the head being rotatable through 360° about the outer axis.

16. The shower fixture defined in claim 15 wherein one of the sockets is tubular and forms a passage between the head and the interior of the respective tube, the other socket blocking flow from the respective tube.

17. The shower fixture defined in claim 1 wherein the element is rigid and U-shaped and extends between the outer ends of the tubes, the tubes being provided at their outer ends with plugs blocking flow out of the outer ends and with screws securing the outer ends, element, and plug together.

18. The shower fixture defined in claim 17, further comprising a separate cover secured on a concave inner side of the element.

19. The shower fixture defined in claim 1 wherein outer portions of the tubes lie in a plane forming an angle of between 10° and 45° to a plane formed by inner portions of the tube.

20. The shower fixture defined in claim 1 wherein the base is of generally triangular section, is formed with through-going holes adapted to receive screws securing the base to a wall, and is provided with a removable decorative cover concealing the holes.

* * * * *